US011495173B2

(12) United States Patent
Hung et al.

(10) Patent No.: US 11,495,173 B2
(45) Date of Patent: Nov. 8, 2022

(54) DISPLAY DEVICE AND DRIVING METHOD THEREOF

(71) Applicant: Innolux Corporation, Miao-Li County (TW)

(72) Inventors: Chao-Yi Hung, Miao-Li County (TW); Minghuei Wang, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 0 days.

(21) Appl. No.: 17/180,700

(22) Filed: Feb. 19, 2021

(65) Prior Publication Data

US 2021/0280126 A1 Sep. 9, 2021

(30) Foreign Application Priority Data

Mar. 3, 2020 (CN) ..... 202010140590.3

(51) Int. Cl.

| | |
|---|---|
| ***G09G 3/32*** | (2016.01) |
| ***G09G 3/20*** | (2006.01) |
| ***G09G 3/3208*** | (2016.01) |
| *G09G 3/22* | (2006.01) |

(52) U.S. Cl.

CPC ..... *G09G 3/32* (2013.01); *G09G 3/2003* (2013.01); *G09G 3/2022* (2013.01); *G09G 3/2074* (2013.01); *G09G 3/3208* (2013.01); *G09G 3/2018* (2013.01); *G09G 3/22* (2013.01); *G09G 2300/0452* (2013.01); *G09G 2310/0235* (2013.01); *G09G 2320/0626* (2013.01); *G09G 2360/145* (2013.01)

(58) Field of Classification Search

CPC .. G09G 3/2003; G09G 3/2018; G09G 3/2022; G09G 3/2074; G09G 3/22; G09G 3/32; G09G 3/3208; G09G 3/3406; G09G 3/3413; G09G 3/36; G09G 2310/0235; G09G 2300/0452; G09G 2320/062; G09G 2320/0626; G09G 2320/064; G09G 2360/145

USPC ..... 345/694

See application file for complete search history.

(56) References Cited

U.S. PATENT DOCUMENTS

| | | | | |
|---|---|---|---|---|
| 2007/0035707 | A1 | 2/2007 | Margulis | |
| 2012/0162283 | A1* | 6/2012 | Miyairi | G09G 3/3413 345/690 |
| 2021/0043130 | A1* | 2/2021 | Dai | G01J 1/4204 |
| 2021/0072599 | A1* | 3/2021 | Mei | G02F 1/133528 |

* cited by examiner

*Primary Examiner* — Jason M Mandeville

(74) *Attorney, Agent, or Firm* — JCIPRNET

(57) ABSTRACT

The disclosure provides a display device and a driving method thereof. The display device includes a light emitting module and a display panel. The light emitting module includes an optical sensor and multiple light emitting diodes (LEDs). The LEDs are adjacent to the optical sensor. The LEDs emit red, green, and blue light. The LEDs dynamically convert brightness of the red, green, and blue light. The display panel is disposed on the light emitting module. The display device of the disclosure may achieve a full-screen display or have a higher resolution.

15 Claims, 3 Drawing Sheets

DISPLAY DEVICE AND DRIVING METHOD THEREOF

CROSS-REFERENCE TO RELATED APPLICATION

This application claims the priority benefit of China application serial no. 202010140590.3, filed on Mar. 3, 2020. The entirety of the above-mentioned patent application is hereby incorporated by reference herein and made a part of this specification.

BACKGROUND

Technical Field

The disclosure relates to a display device and a driving method thereof, and more particularly to a display device capable of full-screen display and having a higher resolution, and a driving method thereof.

Description of Related Art

With the vigorous development of electronic products, display technology applied to electronic products has also been improved continuously. Electronic devices for display continue to improve toward larger screen displays or display effects with a higher resolution.

SUMMARY

The disclosure relates to a display device which may achieve a full-screen display or have a higher resolution.

The disclosure relates to a driving method of a display device, which may be used to drive the above display device.

According to an embodiment of the disclosure, a display device includes a light emitting module and a display panel. The light emitting module includes an optical sensor and multiple light emitting diodes (LEDs). The LEDs are adjacent to the optical sensor. The LEDs emit red light, green light and blue light. The LEDs dynamically convert brightness of the red light, the green light and the blue light. The display panel is disposed on the light emitting module.

According to an embodiment of the disclosure, a driving method of a display device includes the following steps. First, the display device is provided. The display device includes an optical sensor, multiple light emitting diodes (LEDs) and a display panel. The LEDs are adjacent to the optical sensor and include multiple first LEDs, multiple second LEDs, and multiple third LEDs. The first LEDs, the second LEDs and the third LEDs respectively emit light of different colors. The display panel is disposed on the LEDs. Next, a frame time is generated. When the display device is in a display state, the frame time is divided into a first frame time, a second frame time, a third frame time and a fourth frame time. The second frame time continues after the first frame time. The third frame time continues after the second frame time. The fourth frame time continues after the third frame time. When the optical sensor is not performing a function, one of the first LEDs, the second LEDs and the third LEDs are sequentially turned on while the other two are turned off in the first frame time, the second frame time and the third frame time. The first LEDs, the second LEDs and the third LEDs are turned off in the fourth frame time.

In summary, since the display device of the embodiment of the disclosure uses a direct-type light emitting module and uses the LEDs to respectively emit red light, green light, and blue light to make the display panel present a color image, the display panel of the embodiment does not need to be additionally provided with a color filter layer, thereby providing a higher light transmittance for the optical sensor. Therefore, compared with the existing display devices using edge-type light emitting modules or color filter layers, the display device of the embodiment may have higher brightness or higher resolution. In addition, the local dimming and/or color sequential method may be used to adjust and control the turning on or turning off of the LEDs in the first area and the second area respectively, thereby achieving a full-screen display effect when the optical sensor is not performing a function.

BRIEF DESCRIPTION OF THE DRAWINGS

The accompanying drawings are included to provide a further understanding of the disclosure, and are incorporated in and constitute a part of this specification. The accompanying drawings illustrate embodiments of the disclosure and, together with the description, serve to explain the principles of the disclosure.

DESCRIPTION OF THE EMBODIMENTS

Figure 1:
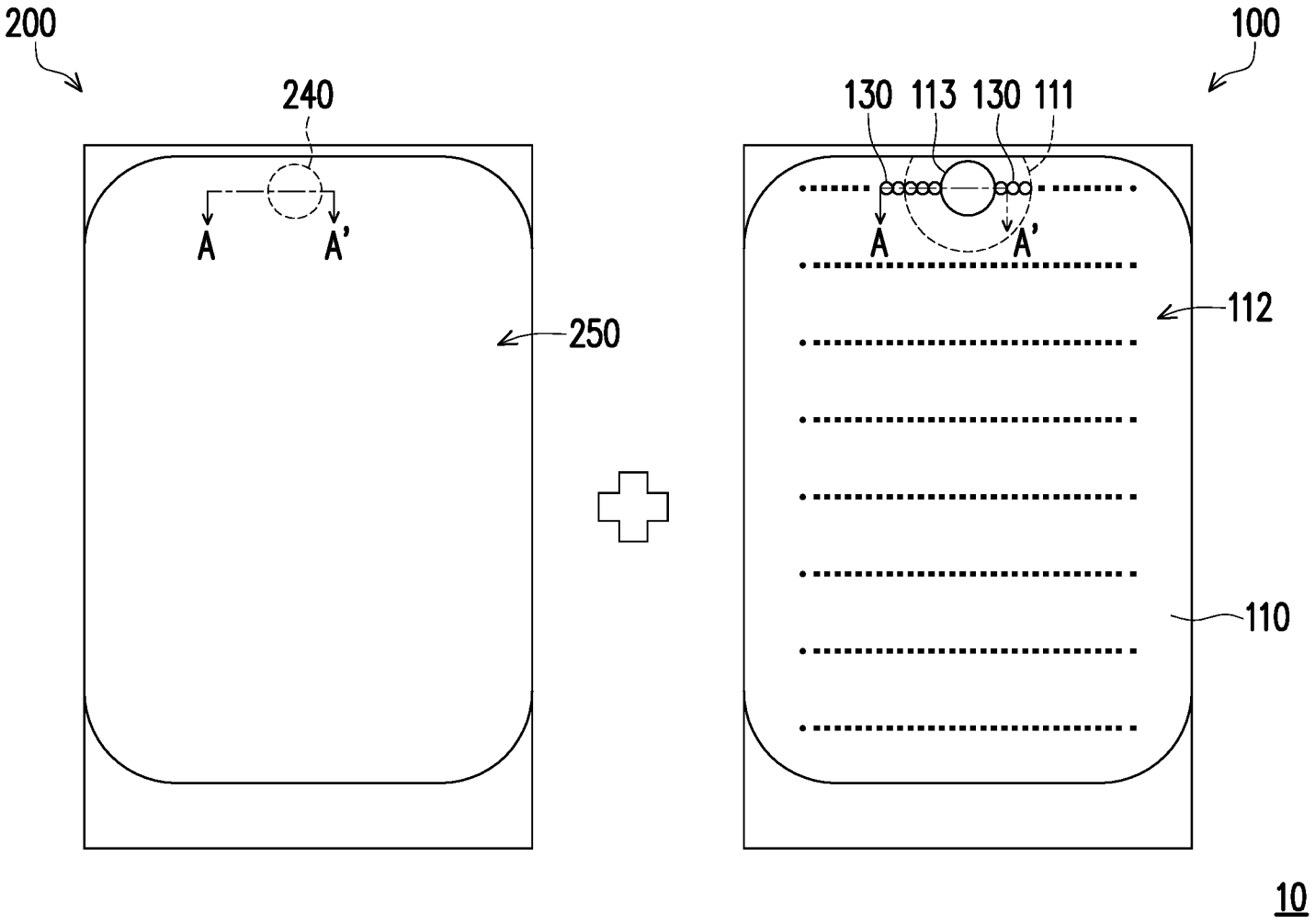
FIG. 1 is a schematic top view of a display panel and a light emitting module of a display device according to an embodiment of the disclosure.

This disclosure may be understood by referring to the following detailed description in conjunction with the accompanying drawings. It should be noted that, in order to facilitate understanding and for the concision of the drawings, only a part of the electronic device is shown in the drawings in this disclosure, and the specific components in the drawings are not drawn according to actual scale. In addition, the number and size of each component in the drawings are only exemplary and are not used to limit the scope of the disclosure.

In the following description and claims, words such as "having," "including" and "comprising" are open-ended words and thus should be interpreted as meaning "including but not limited to."

The description that one structure (or layer, component, substrate) is located on another structure (or layer, component, substrate) described in the disclosure may mean that the two structures are adjacent and directly connected, or may mean that the two structures are adjacent but not directly connected. Indirect connection means that there is at least one intermediate structure (or intermediate layer, intermediate component, intermediate substrate, intermediate space) between the two structures, and the lower surface of the one structure is adjacent or directly connected to the upper surface of the intermediate structure, and the upper surface of the other structure is adjacent or directly connected to the lower surface of the intermediate structure, and the intermediate structure may be composed of a single-layer or multi-layer physical structure or a non-physical structure and is not particularly limited. In the disclosure, when a certain structure is "on" another structure, it may mean that the certain structure is "directly" on another structure, or that the certain structure is "indirectly" on another structure; that is, there is at least one structure between the certain structure and another structure.

Although the terms "first," "second," "third" and the like may be used to describe various components, the components are not limited to the terms. The terms are only used to distinguish one single component from other components in the specification. The same terms may not be used in the claims, and may be replaced with "first," "second," "third" and the like in the order in which elements in the claims are declared. Accordingly, a first component in the following description may be a second component in the claims.

The electronic device of the disclosure may include, for example, a display device, an antenna device, a sensing device, a touch display device, a curved display device, a free shape display device, or a bendable or flexible splicing electronic device, but it is not limited thereto. The electronic device may include, for example, a light emitting diode, liquid crystal, fluorescence, phosphor, other suitable display media, or a combination of the foregoing, but it is not limited thereto. The light emitting diode may include, for example, an organic light emitting diode (OLED), an inorganic light emitting diode (LED), a mini LED, a micro LED, or a quantum dot (QD, such as QLED and QDLED) light emitting diode, or other suitable materials or any combination of the foregoing, but it is not limited thereto. The antenna device may be, for example, a liquid crystal antenna, but it is not limited thereto. It should be noted that the electronic device may be any combination of the foregoing, but it is not limited thereto. In addition, the appearance of the electronic device may be rectangular, circular, polygonal, a shape with curved edges, or other suitable shapes. The electronic device may have peripheral systems such as a driving system, a control system, a light source system, a shelf system and the like to support a display device or an antenna device. The following takes a display device as an example.

It should be understood that in the following embodiments, the features in several different embodiments may be replaced, reorganized, or mixed to complete other embodiments without departing from the spirit of the disclosure. As long as the features of the embodiments do not violate the spirit of the disclosure or conflict each other, they may be mixed and matched as desired.

Reference will now be made in detail to the exemplary embodiments of the disclosure, and examples of the exemplary embodiments are illustrated in the accompanying drawings. Whenever possible, the same reference numerals are used in the drawings and the description to indicate the same or similar parts.

Figure 2:
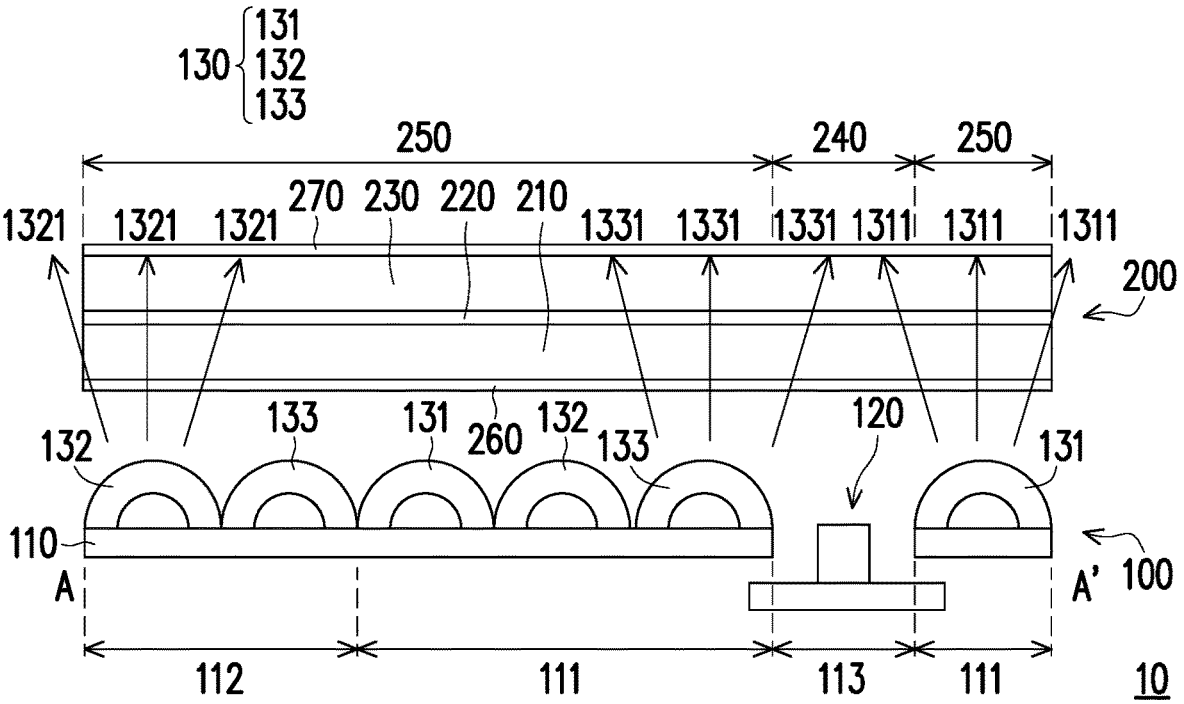
FIG. 2 is a schematic cross-sectional view of the display device of FIG. 1 taken along the section line A-A'.
Figure 3:
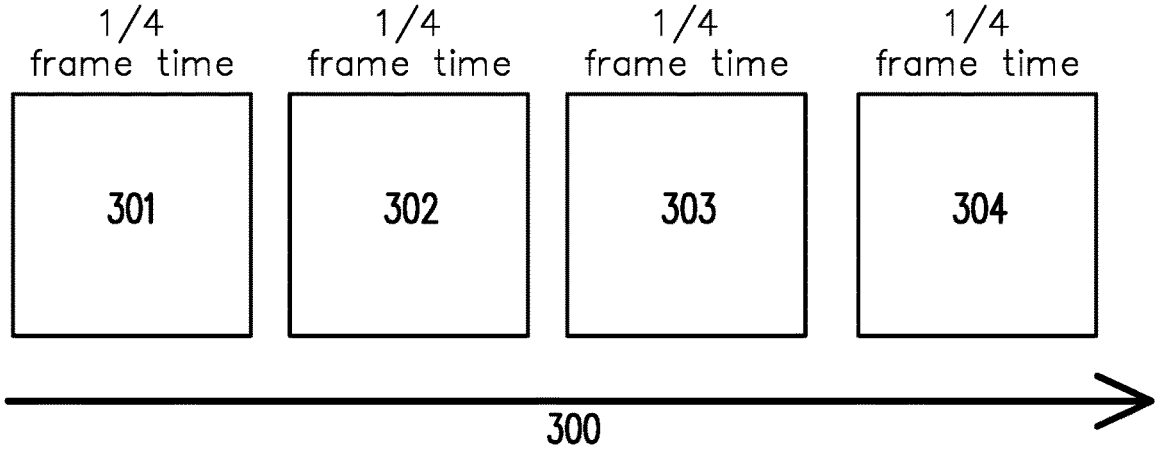
FIG. 3 is a schematic view of color sequence conversion according to an embodiment of the disclosure.
Figure 4B:
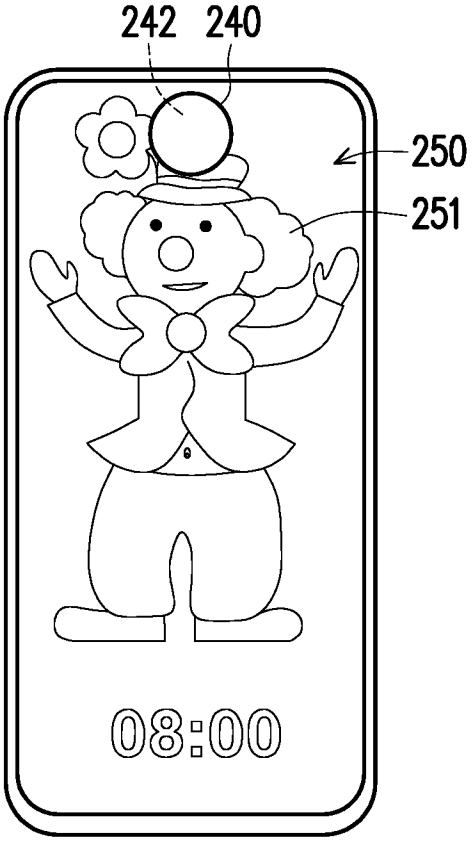
FIG. 4B is an image of the display panel of the display device according to an embodiment of the disclosure when the optical sensor is performing a function.
Figure 4A:
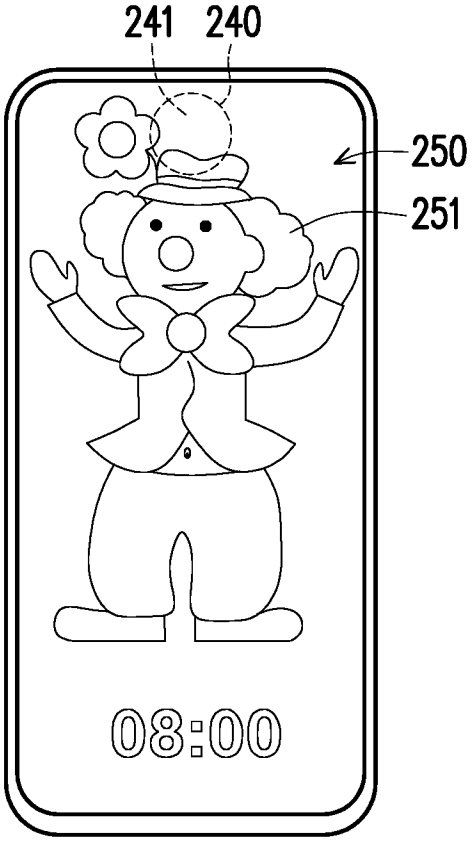
FIG. 4A is an image of the display panel of the display device according to an embodiment of the disclosure when the optical sensor is not performing a function.

FIG. 1 is a schematic top view of a display panel and a light emitting module of a display device according to an embodiment of the disclosure. FIG. 2 is a schematic cross-sectional view of the display device of FIG. 1 taken along the section line A-A'. FIG. 3 is a schematic view of color sequence conversion according to an embodiment of the disclosure. FIG. 4A is an image of the display panel of the display device according to an embodiment of the disclosure when the optical sensor is not performing a function. FIG. 4B is an image of the display panel of the display device according to an embodiment of the disclosure when the optical sensor is performing a function.

Please refer to FIG. 1 and FIG. 2; a display device 10 of the embodiment includes a light emitting module 100 and a display panel 200. The light emitting module 100 includes a substrate 110, an optical sensor 120 and multiple light emitting diodes (LEDs) 130. The LEDs 130 are disposed around the optical sensor 120. The LEDs 130 may respectively emit red light, green light and blue light, and the LEDs 130 may dynamically convert brightness of the red light, the green light and the blue light. The dynamic conversion of the brightness of the red light, the green light, and the blue light described above means that the brightness of different LEDs may be adjusted in turn, but the color sequence is not limited. The disclosure describes an example in which the substrate 110 has a first area 111, a second area 112, and a third area 113. The first area 111 is adjacent to the third area 113; the second area 112 is adjacent to the first area 111; and the first area 111 is located between the third area 113 and the second area 112. In another embodiment, the first area 111 may optionally surround the third area 113; the second area 112 may optionally surround the first area 111; and the first area 111 is located between the third area 113 and the second area 112. The above-mentioned division of the substrate 110 into three areas is only an example of the disclosure, and different division methods are possible. For example, the substrate 110 may be divided into multiple first areas 111 and multiple second areas 112, and the first areas 111 and the second areas 112 are alternately disposed at fixed intervals, and the shape and size of the divided regions are not limited and may be changed depending on the overall condition of the display device 10, as long as it is suitable for the method of the embodiment.

In the embodiment, the substrate 110 may be a transparent substrate, a metal substrate, or a graphite substrate. The transparent substrate is, for example, a transparent plastic substrate or a glass substrate. For example, the material of the substrate 110 includes glass, quartz, sapphire, ceramic, polycarbonate (PC), polyimide (PI), polyethylene terephthalate (PET), glass fiber, other suitable substrate materials, or a combination of the foregoing, but it is not limited thereto.

At least a portion of the optical sensor 120 may be disposed in the third area 113. The third area 113 may be an opening, for example, so that the optical sensor 120 may be embedded in the substrate 110, but it is not limited thereto. In some embodiments, the at least a portion of the optical sensor 120 may be fixed in the third area 113 of the substrate 110. In another embodiment, the optical sensor 120 may be located in the display panel 200. In this embodiment, the optical sensor 120 is, for example, a camera or a fingerprint sensor, but it is not limited thereto.

The LEDs 130 are adjacent to the optical sensor 120 and are disposed in the first area 111 and the second area 112 of the substrate 110. The LEDs 130 may respectively emit red light, green light and blue light, and the LEDs 130 may dynamically convert brightness of the red light, the green light and the blue light. In detail, in the embodiment, the LEDs 130 may further include multiple first LEDs 131, multiple second LEDs 132, and multiple third LEDs 133. In other words, the first LEDs 131, the second LEDs 132 and the third LEDs 133 are all disposed in the first area 111 and the second area 112 of the substrate 110. In the embodiment, the first LEDs 131 may emit red light; the second LEDs 132 may emit green light; and the third LEDs 133 may emit blue light, but they are not limited thereto. In some embodiments, the first LEDs may also emit green or blue light; the second LEDs may also emit red or blue light; and the third LEDs may also emit red or green light; it is sufficient that the first LEDs, the second LEDs and the third LEDs respectively emit light of different colors.

In this embodiment, the display panel 200 is disposed on the light emitting module 100, so that the light emitting module 100 may emit light toward the display panel 200 and present an image on the display panel 200. The image may be, for example, a dynamic display image or a static display image. Therefore, the light emitting module 100 of the embodiment is a direct-type light emitting module. The display panel 200 includes a first polarizing layer 260, a first substrate 210, a display medium 220, a second substrate 230, and a second polarizing layer 270. The first substrate 210 and the second substrate 230 are disposed to face each other, and the display medium 220 is located between the first substrate 210 and the second substrate 230. The first substrate 210 is located between the second substrate 230 and the light emitting module 100. In an embodiment of the disclosure, the first substrate 210 includes a pixel structure, and the display medium 220 includes liquid crystal, but they are not limited thereto. In another embodiment of the disclosure, the second substrate 230 may include a pixel structure, and the display medium 220 includes liquid crystal, but they are not limited thereto. The display panel 200 may further include a viewing angle compensation layer (not shown) and other layers suitable for display.

In this embodiment, the display panel 200 may not include a color filter layer, so that the light transmittance of the display panel 200 may be increased to provide a higher light transmittance to the optical sensor 120. The light transmittance is defined as the percentage of the brightness of the light emitted by the LEDs 130 after passing through the second polarizing layer 270 divided by the brightness of the light emitted by the LEDs 130 before entering the first polarizing layer 260. In the embodiment, the light transmittance of the display panel 200 is, for example, about 30%, but it is not limited thereto. Since the display device 10 of the embodiment does not need to be additionally provided with a color filter layer, but instead uses a direct-type light emitting module and uses the LEDs 130 to respectively emit the red light, the green light, and the blue light to make the display panel 200 present an image, the display device 10 of the embodiment thus may have a higher resolution than an existing display device which uses a color filter layer to present an image. In the embodiment, the display panel 200 may also optionally include a black matrix (BM) layer, but it is not limited thereto.

In this embodiment, the display panel 200 further includes an optical sensing area 240 and a display area 250. The optical sensing area 240 is disposed corresponding to the optical sensor 120. The display area 250 is adjacent to the optical sensing area 240, and the display area 250 is disposed corresponding to the first area 111 and the second area 112 of the substrate 110. In other words, the light emitted by the LEDs 130 in the first area 111 and the second area 112 of the substrate 110 may present an image 251 in the display area 250 of the display panel 200. In an embodiment of the disclosure, the red light emitted by the first LEDs 131, the green light emitted by the second LEDs 132, and the blue light emitted by the third LEDs 133 in the first area 111 and the second area 112 may make the display area 250 of the display panel 200 present the image 251.

In addition, because the light emitting module 100 of the embodiment is a direct-type light emitting module, it is different from the edge-type light emitting module. The light emitting module 100 of the embodiment may generate high light transmittance characteristics, and may also use the LEDs 130 to control the light emitting type to increase the illumination range of the LEDs 130 on the display panel 200. For example, the overlapping range of the light emitted from the LEDs 130 may be controlled by adjusting the cone angles of the LEDs 130. Please refer to FIG. 2, light 1331 emitted by the third LEDs 133 on the left side of the third area 113 can illuminate not only the corresponding position of the display panel 200 above it but also the optical sensing area 240 of the display panel 200 above the third area 113. Similarly, light 1311 emitted by the first LEDs 131 on the right side of the third area 113 can illuminate not only the corresponding position of the display panel 200 above it but also the optical sensing area 240 of the display panel 200 above the third area 113. Therefore, in the embodiment, since the first area 111 is adjacent to the third area 113 and the LEDs 130 in the first area 111 may control the light type, the red light emitted by the first LEDs 131, the green light emitted by the second LEDs 132 and the blue light emitted by the third LEDs 133 in the first area 111 may illuminate the optical sensing area 240 above the third area 113. In this way, when the optical sensor 120 is not performing a function, the optical sensing area 240 of the display panel 200 may also present an image 241, thereby generating a full-screen display, as shown in FIG. 4A. At this time, the image 241 of the optical sensing area 240 of the display panel 200 and the image 251 of the display area 250 may present a continuous image. In other words, the image 241 of the optical sensing area 240 and the image 251 of the display area 250 may match each other.

However, when the optical sensor 120 needs to perform a function (for example, when the camera performs a photographing function, a video recording function or a fingerprint recognition function), the image 241 of the optical sensing area 240 is turned off, or the optical sensing area 240 is rendered white, but at the same time, the image 251 of the display area 250 is not affected, so that the optical sensor 120 may perform its function (such as the photographing function) and the display area 250 may still present the image 251. In order to meet the above requirements, the display device 10 of the embodiment further uses a local dimming method and/or a color sequential method, which are described as follows.

The display device 10 of the embodiment may adjust the brightness of the red light, the green light and the blue light emitted by the LEDs 130 in the first area 111 and the second area 112 by local dimming. That is, the local dimming method may be used to control the turning on or turning off of the first LEDs 131, the second LEDs 132 and the third LEDs 133 in the first area 111 and the second area 112 by dividing them into different areas for adjustment and control, thereby adjusting the brightness of the red light, the green light and the blue light in the first area 111 and the second area 112. For example, when the optical sensor 120 is performing a function, the LEDs 130 in the first area 111 may be turned off by the local dimming method, so that the optical sensing area 240 of the display panel 200 presents the image 242. In the embodiment, the image 242 may be a black image, but the display area 250 may still present the image 251, as shown in FIG. 4B. In an embodiment, the image 242 may be the black image, but it is not limited thereto. That is, in some embodiments, the image 242 may be adjusted according to the state of the optical sensor 120 when it is performing the function, so that the image 242 may also be a red image or a blue image, or other images with different colors or combinations of different colors, as long as it may perform the function of the disclosure.

In addition, please refer to FIG. 3, the driving method of the display device 10 of the embodiment may also adopt a color sequential method, so that the LEDs 130 in the first area 111 and the second area 112 may emit the red light, the green light, and the blue light in a time sharing way. Specifically, in an interval of a frame time 300, by dividing the frame time 300 into several equal parts, the LEDs 130 in the first area 111 and the second area 112 may sequentially emit lights of different colors. For example, if the frame time 300 is divided into three equal parts, the LEDs 130 in the first area 111 and the second area 112 emit three kinds of light (such as red light, green light and blue light) sequentially in the three equal parts. In an embodiment of the disclosure, as shown in FIG. 3, the frame time 300 may be divided into four equal parts: first, a first frame time 301; next, a second frame time 302 which continues after the first frame time 301; then, a third frame time 303 which continues after the second frame time 302; and then a fourth frame time 304 which continues after the third frame time 303. Therefore, the LEDs 130 in the first area 111 and the second area 112 may sequentially emit four kinds of light, such as red light, green light, blue light, and white light, and use the visual persistence effect of human eyes to produce a color mixing effect. Please refer to FIG. 4A and FIG. 4B; in the embodiment, when the optical sensor 120 is not performing the function, one of the first LEDs 131, the second LEDs 132 and the third LEDs 133 in the first area 111 may be sequentially turned on while the other two may be turned off in the first frame time 301, the second frame time 302 and the third frame time 303, and the first LEDs 131, the second LEDs 132 and the third LEDs 133 in the first area 111 may be turned off in the fourth frame time 304. In other words, in the frame time 300, red light, green light, blue light, and no light may be emitted sequentially, so that the image 241 of the optical sensing area 240 of the display panel 200 and the image 251 of the display area 250 present the continuous image, as shown in FIG. 4A. However, when the optical sensor 120 is performing the function, the first LEDs 131, the second LEDs 132 and the third LEDs 133 are turned off in the first frame time 301, the second frame time 302 and the third frame time 303, and the first LEDs 131, the second LEDs 132 and the third LEDs 133 in the first area 111 are simultaneously turned on in the fourth frame time 304, so that the optical sensing area 240 of the display panel 200 may present a substantially white image, as shown in FIG. 4B.

For example, as shown in FIG. 3, in the driving method of the display device 10 of the embodiment, one frame time 300 (which is, for example, 16 ms, but it is not limited thereto) of the first area 111 is first divided evenly into four equal parts, and each equal part is 4 ms. For example, when the display device 10 is in the display state, a frame time 300 (16 ms) is generated, and the frame time 300 is divided into a first frame time 301 (4 ms), a second frame time 302 (4 ms), a third frame time 303 (4 ms) and a fourth frame time 304 (4 ms). Specifically, the second frame time 302 (4 ms) continues after the first frame time 301 (4 ms), and the third frame time 303 (4 ms) continues after the second frame time 302 (4 ms), and the fourth frame time 304 (4 ms) continues after the third frame time 303 (4 ms). Then, when the optical sensor 120 is not performing a function, in the first frame time 301 (4 ms), the first LEDs 131 are turned on, and the second LEDs 132 and the third LEDs 133 are turned off to emit the red light 1311; in the second frame time 302 (4 ms), the second LEDs 132 are turned on, and the first LEDs 131 and the third LEDs 133 are turned off to emit the green light 1321; in the third frame time 303 (4 ms), the third LEDs 133 are turned on, and the first LEDs 131 and the second LEDs 132 are turned off to emit the blue light 1331; and in the fourth frame time 304 (4 ms), the first LEDs 131, the second LEDs 132 and the third LEDs 133 are turned off. Then, the red light 1331, the green light 1321, the blue light 1331, and no light are sequentially emitted in the above sequence so that the optical sensing area 240 of the display panel 200 presents the image 241, which may be a continuous image with the image 251 provided by the display area 250 to achieve the full-screen display, as shown in FIG. 4A. However, when the optical sensor 120 is performing a function, the first LEDs 131, the second LEDs 132 and the third LEDs 133 are turned off throughout the first frame time 301 (4 ms), the second frame time 302 (4 ms) and the third frame time 303 (4 ms); and the first LEDs 131, the second LEDs 132, and the third LEDs 133 are turned on in the fourth frame time 304 (4 ms), so that the image 242 of the optical sensing area 240 of the display panel 200 may present a white image so that the optical sensor 120 may perform its function, as shown in FIG. 4B.

In the embodiment, a frame time of the second area 112 may be divided evenly into three parts (red light, green light, and blue light). Therefore, when the optical sensor 120 is performing the function or is not performing the function, one of the first LEDs 131, the second LEDs 132 and the third LEDs 133 in the second area 112 may be sequentially turned on periodically while the other two are turned off to sequentially emit the red light, the green light, and the blue light, so that the display area 250 of the display panel 200 presents the image 251. For example, first, one frame time of the second area 112 (which is, for example, 16 ms, but it is not limited thereto) of the second area 112 is divided evenly into three equal parts, and each equal part is 16/3 ms. For example, the frame time of the second area 112 is divided into a first frame time (16/3 ms), a second frame time (16/3 ms) and a third frame time (16/3 ms). Then, in the first frame time (16/3 ms), the first LEDs 131 are turned on, and the second LEDs 132 and the third LEDs 133 are turned off to emit the red light; in the second frame time (16/3 ms), the second LEDs 132 are turned on, and the first LEDs 131 and the third LEDs 133 are turned off to emit the green light; and in the third frame time (16/3 ms), the third LEDs 133 are turned on, and the first LEDs 131 and the second LEDs 132 are turned off to emit the blue light. Then, the red light, the green light, and the blue light are periodically emitted in the above sequence, so that the display area 250 of the display panel 200 presents the image 251, as shown in FIG. 4A and FIG. 4B.

In some embodiments, the optical sensor 120 may be a camera. When the optical sensor 120 is performing a photographing function, if ambient light that enters the optical sensor 120 has low or weak brightness in a certain wavelength band, the local dimming or color sequential method may be used so that the light brightness of the wavelength band corresponding to the LEDs 130 in the first area 111 is increased to enhance the intensity of light entering from the outside. For example, when the brightness of blue light incident from ambient light is relatively weak, the local dimming or color sequential method may be used so that the brightness of the blue light emitted by the third LEDs 133 in the first area 111 is increased, or blue light with appropriate brightness is turned on in the third frame time 303 as shown in FIG. 3, and the brightness of the red light emitted by the first LEDs 131 and the brightness of the green light emitted by the second LEDs 132 are reduced or turned off. In another situation in the embodiment, if the ambient light that enters the optical sensor 120 has sufficient light intensity, it may be set that in the first frame time 301, the second frame time 302, the third frame time 303 and the fourth frame time 304, the LEDs 130 in the first area 111 are all turned off.

In addition, in another embodiment, when the optical sensor 120 is used for fingerprint recognition, the color sequential method may be used to make the LEDs 130 in the first area 111 emit white light during most of the frame time 300. For example, the fourth frame time 304 may account for one-third of the frame time 300, and the first frame time 301, the second frame time 302 and the third frame time 303 each account for two ninths of the frame time 300. When the optical sensor 120 is performing fingerprint recognition, the LEDs 130 in the first area 111 may be turned off in the first frame time 301, the second frame time 302 and the third frame time 303, and the LEDs 130 in the first area 111 may be turned on in the fourth frame time 304.

In addition, in another embodiment, when the optical sensor 120 is used for external indication detection, such as detecting a laser pointer indication, the local dimming or color sequential method may be used to reduce the brightness of the LEDs 130 in the first area 111 to facilitate the optical sensor 120 to detect external indications.

In summary, since the display device of the embodiment of the disclosure uses a direct-type light emitting module as an example, and uses the LEDs to respectively emit the red light, the green light, and the blue light to make the display panel present a color image, the display panel of the embodiment does not need to be additionally provided with a color filter layer, thereby providing the maximum light transmittance for the optical sensor. Therefore, compared with the existing display devices using edge-type light emitting modules or color filter layers, the display device of the embodiment may have higher brightness or higher resolution. In addition, the local dimming and/or color sequential method may be used to adjust and control the turning on and/or turning off of multiple LEDs respectively, thereby achieving a full-screen display effect when the optical sensor is not performing a function. The direct-type light emitting module may also be replaced with other light emitting devices capable of emitting red light, green light and blue light respectively, and it is not limited herein.

Finally, it should be noted that the above embodiments are only used to illustrate the technical solutions of the disclosure and are not intended to limit it. Although the disclosure has been described in detail with reference to the above embodiments, persons of ordinary skill in the art should understand that they may still modify the technical solutions described in the above embodiments, or replace some or all of the technical features therein with equivalents, and that such modifications or replacements of corresponding technical solutions do not substantially deviate from the scope of the technical solutions of the embodiments of the disclosure.

What is claimed is:

1. A display device comprising:

a light emitting module comprising:

an optical sensor;

a substrate comprising a first area, wherein the first area is adjacent to the optical sensor; and a plurality of light emitting diodes adjacent to the optical sensor and disposed in the first area, wherein the plurality of light emitting diodes emit red light, green light and blue light, and the plurality of light emitting diodes dynamically convert brightness of the red light, the green light and the blue light; and a display panel disposed on the light emitting module, and comprising:

an optical sensing area located corresponding to the optical sensor; and a display area surrounding the optical sensing area, and the first area is disposed corresponding to the display area, wherein the plurality of light emitting diodes further comprise:

a plurality of first light emitting diodes which emit the red light;

a plurality of second light emitting diodes which emit the green light; and a plurality of third light emitting diodes which emit the blue light, wherein a frame time of the first area is divided evenly into four equal parts, and the four equal parts corresponding to a first frame time, a second frame time which directly continues after the first frame time, a third frame time which directly continues after the second frame time, and a fourth frame time which directly continues after the third frame time respectively, wherein when the optical sensor is performing a sensing function, the first light emitting diodes, the second light emitting diodes and the third light emitting diodes in the first area are turned off in the first frame time, the second frame time, and the third frame time, and the first light emitting diodes, the second light emitting diodes and the third light emitting diodes in the first area are turned on in the fourth frame time such that the optical sensing area of the display panel presents a white image, and wherein when the optical sensor is not performing the sensing function, one of the first light emitting diodes, the second light emitting diodes and the third light emitting diodes in the first area are sequentially turned on while the other two are turned off in the first frame time, the second frame time and the third frame time to display an image, and the first light emitting diodes, the second light emitting diodes and the third light emitting diodes in the first area are turned off in the fourth frame time.

2. The display device according to claim 1, wherein the substrate further comprises a second area and a third area, wherein the first area is adjacent to the third area, the second area is adjacent to the first area, and the first area is located between the third area and the second area, wherein the plurality of light emitting diodes are further disposed in the second area, and the display area is disposed corresponding to the first area and the second area.

3. The display device according to claim 2, wherein the first area surrounds the third area, and the second area surrounds the first area.

4. The display device according to claim 2, wherein at least a portion of the optical sensor is disposed in the third area, and the optical sensing area is located corresponding to the third area.

5. The display device according to claim 2, wherein in the frame time, one of the first light emitting diodes, the second light emitting diodes and the third light emitting diodes in the second area are sequentially turned on while the other two are turned off.

6. The display device according to claim 5, wherein the frame time of the second area is divided into a first frame time, a second frame time which continues after the first frame time, and a third frame time which continues after the second frame time, and in the first frame time of the second area, the first light emitting diodes are turned on, and the second light emitting diodes and the third light emitting diodes are turned off.

7. The display device according to claim 1, wherein when the optical sensor is not performing the sensing function, the optical sensing area of the display panel presents a first image, the display area of the display panel presents a second image, and the first image and the second image present a continuous image.

8. The display device according to claim 1, wherein the display panel comprises a first substrate, a second substrate disposed opposite to the first substrate, a display medium disposed between the first substrate and the second substrate, and the display medium comprises liquid crystal.

9. The display device according to claim 1, wherein the display panel does not comprise a color filter layer.

10. The display device according to claim 1, wherein the light emitting module is a direct-type light emitting module.

11. The display device according to claim 1, wherein the optical sensor is a camera.

12. The display device according to claim 1, wherein the substrate further comprises a second area adjacent to the first area, the second area surrounds the first area, the first area is between the optical sensor and the second area, the first area and the second area correspond to the display area of the display panel, and at least a portion of the plurality of light emitting diodes overlap the second area in a top view of the display device.

13. A driving method of a display device, comprising:

providing the display device which comprises:

an optical sensor;

a plurality of light emitting diodes adjacent to the optical sensor and which comprise a plurality of first light emitting diodes, a plurality of second light emitting diodes and a plurality of third light emitting diodes, wherein the first light emitting diodes, the second light emitting diodes and the third light emitting diodes respectively emit light of different colors; and a display panel disposed on the plurality of light emitting diodes; and an optical sensing area corresponding to the optical sensor and a display area surrounding the optical sensing area, wherein the plurality of light emitting diodes are located in the display area;

generating a frame time, wherein the frame time is divided evenly into four equal parts, and the four equal parts corresponding to a first frame time, a second frame time which directly continues after the first frame time, a third frame time which directly continues after the second frame time, and a fourth frame time which directly continues after the third frame time respectively, wherein when the optical sensor is not performing a sensing function, one of the first light emitting diodes, the second light emitting diodes and the third light emitting diodes are sequentially turned on while the other two are turned off in the first frame time, the second frame time and the third frame time to display an image, and the first light emitting diodes, the second light emitting diodes and the third light emitting diodes are turned off in the fourth frame time, wherein when the optical sensor is performing the sensing function, the first light emitting diodes, the second light emitting diodes and the third light emitting diodes are turned off in the first frame time, the second frame time and the third frame, and the first light emitting diodes, the second light emitting diodes and the third light emitting diodes are turned on in the fourth frame time to present a white image.

14. The driving method of the display device according to claim 13, further comprising:

providing a first image in the optical sensing area, the optical sensing area being located in the display panel; and providing a second image in the display area, the display area being disposed adjacent to the optical sensing area, wherein the first image and the second image present a continuous image.

15. The driving method of the display device according to claim 13, wherein the display device comprises a direct-type light emitting module, and the direct-type light emitting module comprises a plurality of light emitting diodes.

* * * * *